US005400564A

United States Patent [19]

Humphries et al.

[11] Patent Number: 5,400,564

[45] Date of Patent: Mar. 28, 1995

[54] CAPPING MACHINE

[75] Inventors: Glyn A. Humphries, Lindford; Christopher D. Dupres, Horley, both of England

[73] Assignee: GEI Filling Capping & Labelling Limited, England

[21] Appl. No.: 218,804

[22] Filed: Mar. 28, 1994

[30] Foreign Application Priority Data

Mar. 29, 1993 [GB] United Kingdom ..... 9306521

[51] Int. Cl.[6] ..... B65B 7/28; B65B 57/00; B65B 57/04; B67B 3/20

[52] U.S. Cl. ..... 53/75; 53/308; 53/317; 53/331.5

[58] Field of Search ..... 53/75, 76, 308, 317, 53/331.5, 490, 281

[56] References Cited

U.S. PATENT DOCUMENTS 4,535,583 8/1985 Tanaka et al. ..... 53/331.5 X
4,614,077 9/1986 Muto et al. ..... 53/317 X
4,616,466 10/1986 Tanaka et al. ..... 53/317 X
5,321,935 6/1994 Spatz et al. ..... 53/75 X

*Primary Examiner*—Horace M. Culver
*Attorney, Agent, or Firm*—Dorn, McEachran, Jambor & Keating

[57] ABSTRACT

A capping machine for capping a container having a screw-threaded neck portion with a correspondingly screw-threaded cap. The machine comprises retaining means for retaining such a container in a retaining position and a rotary chuck for holding such a cap above the capping position, forward and reverse rotary drive means coupled to the chuck for rotating such a cap in both a clockwise sense and an anticlockwise sense, rotary movement monitoring means constructed and positioned to monitor rotation of the chuck, linear motion means coupled to the chuck to move the chuck both downwardly and upwardly, screwthread-disengagement monitoring means arranged to monitor when the screwthreads of such a cap and neck disengage momentarily as the cap is rotated in the unscrewing sense on the neck and the linear motion means urge the chuck downwardly, and control means connected to the rotary drive means, the rotary movement monitoring means, and the screwthread-disengagement monitoring means. The control means are such as to rotate the cap in the unscrewing sense, monitor the relative angular position of the cap when the screwthreads of the cap and the neck momentarily disengage, by means of the screwthread-disengagement means, and then to rotate the cap in the screwing sense by a predetermined amount dependent upon the length of the screwthreads.

11 Claims, 8 Drawing Sheets

CAPPING MACHINE

The present invention relates to a capping machine for screwing screw-threaded caps on containers.

In previously proposed capping machines, screwthreaded caps are screwed onto bottles or other containers by such capping machines using indirectly powered vertical shafts with cap holding chucks mounted at the lower ends of these shafts. In each case the shaft is rotated in the cap-tightening sense, and the shaft is lowered onto the container to be capped whereupon the cap engages the container thread and is tightened. In an endeavour to obviate over-tightening of the screwthreaded caps a slipping clutch arrangement is normally provided in the chuck, or by stalling of the motor when the cap is tight.

Such machines have the following disadvantages:

1) high chuck angular velocities are required to allow a high throughput of capped containers by the machine, but high chuck angular velocities cause the stored energy of the rotating mass to produce over-tightened caps in spite of the slipping clutch arrangement or motor stalling characteristics;
2) low chuck angular velocities are required to prevent the inertial effects producing overtorque in the capping operation, but such low angular velocities prevent a high machine throughput;
3) there is no provision for checking that the cap is engaged and properly tightened;
4) such tightening control means, whether they be simple friction or magnetic devices, or the construction of motor that gives rise to desired stall characteristics, results in arbitrary calibration. Furthermore, in the case of slipping clutches, there tends to be a calibration drift owing to the lack of real time calibration;
5) there is no method of measuring actual torque, directly from the torque applying parts of the machine, that takes account of inertial forces applied to the cap during the capping operation;
6) there is no method of monitoring the quality achieved in capping operations, such as checking for damaged or crossed threads, broken caps, or presence of foreign material in the thread region; and
7) changing the capping head to take different cap sizes involves mechanical adjustments with the attendant problems of inaccuracy, and it is not normally practical to change the machine speed to allow for different cap characteristics.

It is an aim of the present invention to provide a capping machine which obviates one or more of these problems.

Accordingly the present invention is directed to a capping machine for capping a container having a screwthreaded neck portion with a correspondingly screw-threaded cap, the machine comprising retaining means for retaining such a container in a retaining position and a rotary chuck for holding such a cap above the capping position, forward and reverse rotary drive means coupled to the chuck for rotating such a cap in both a clockwise sense and an anticlockwise sense, rotary movement monitoring means constructed and positioned to monitor rotation of the chuck, linear motion means coupled to the chuck to move the chuck both downwardly and upwardly, screwthread-disengagement monitoring means arranged to monitor when the screwthreads of such a cap and neck disengage momentarily as the cap is rotated in the unscrewing sense on the neck and the linear motion means urge the chuck downwardly, and control means connected to the rotary drive means, the rotary movement monitoring means, and the screwthread-disengagement monitoring means, the control means being such as to rotate the cap in the unscrewing sense, monitor the relative angular position of the cap when the screwthreads of the cap and the neck momentarily disengage, by means of the screwthread-disengagement means, and then to rotate the cap in the screwing sense by a predetermined amount dependent upon the length of the screwthreads.

Preferably, the control means are such as to rotate the cap in the screwing sense by the said predetermined amount at a relatively high angular velocity and/or rate of change of angular velocity, and then to rotate the cap in that sense by a further amount, which is small relative to the said predetermined amount, at a relatively low angular velocity and/or rate of change of angular velocity, to tighten the cap on the neck.

Store means may be provided in the control means to store the values of the said predetermined amount and/or the said further amount.

The control means may be such as to run an initialising procedure at the start of a capping run, in which such a cap is screwed onto such a neck at a slow angular velocity, a measure of the screwthread length is made, and the said predetermined amount and the said further amount are determined and stored in the store means.

Preferably the rotation of the cap by the said predetermined amount is effected by both an angular acceleration and also by a subsequent angular deceleration.

The screwthread-disengagement means may comprise torque monitoring means coupled to the rotary drive means to monitor the torque applied by the latter, the torque monitoring means also being connected to the control means, the latter monitoring the relative angular position of the cap on the neck when such torque changes as the screwthreads momentarily disengage.

Preferably, however, the screwthread-disengagement means comprise linear motion monitoring means constructed and positioned to monitor downward and upward movement of the chuck, the linear motion monitoring means also being connected to the control means, the latter monitoring the relative angular position of the cap on the neck when the chuck moves downwardly as the screwthreads of the cap and neck momentarily disengage.

Preferably when the container has been capped the chuck applies a torque in the unscrewing sense which is a predetermined fraction of the desired tightening torque, to test the capping. This has the advantage that the tightness of the capping can be checked.

The rotary drive means used, may be speed controlled, or torque controlled, or speed and torque controlled in accordance with the desired container to be capped.

An example of a capping machine made in accordance with the present invention will now be described with reference to the accompanying drawings, in which.

Figure 1:
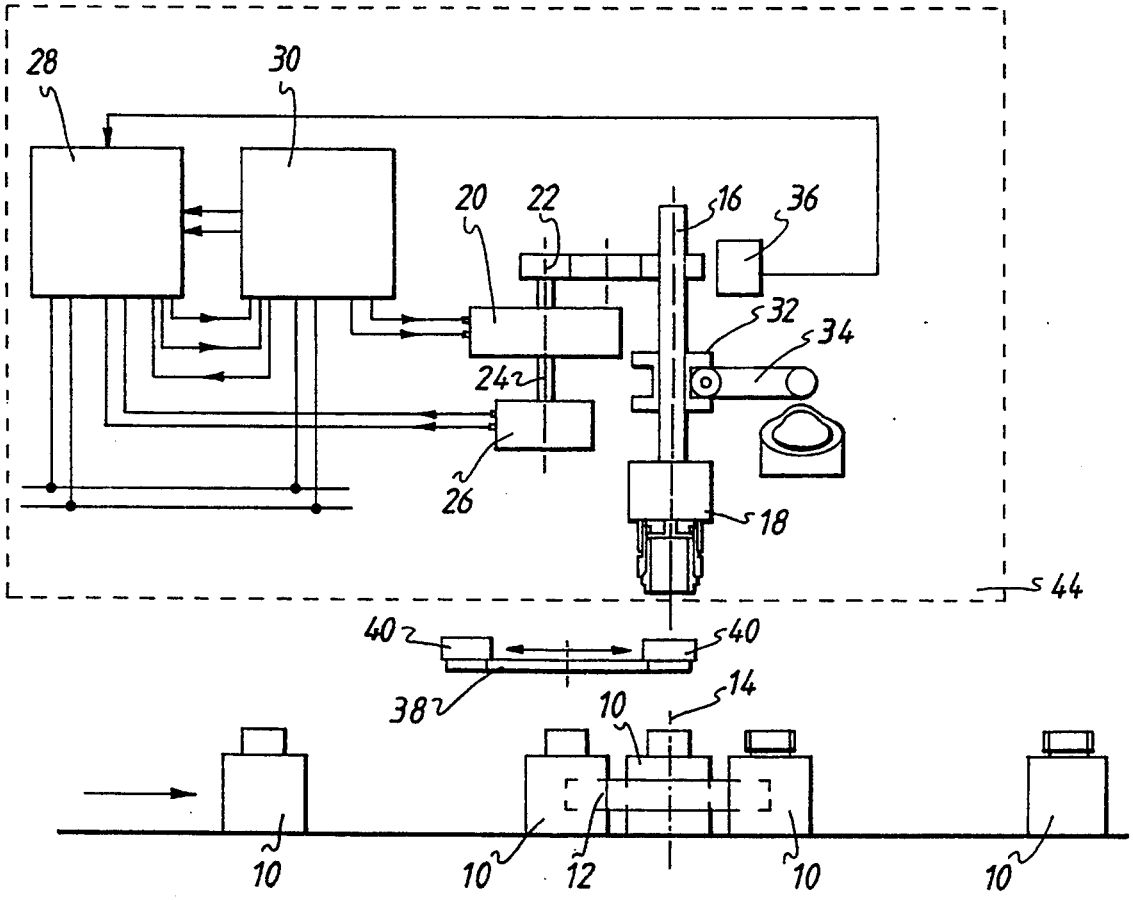
FIG. 1 shows a schematic elevational view of such a capping machine.
Figure 2:
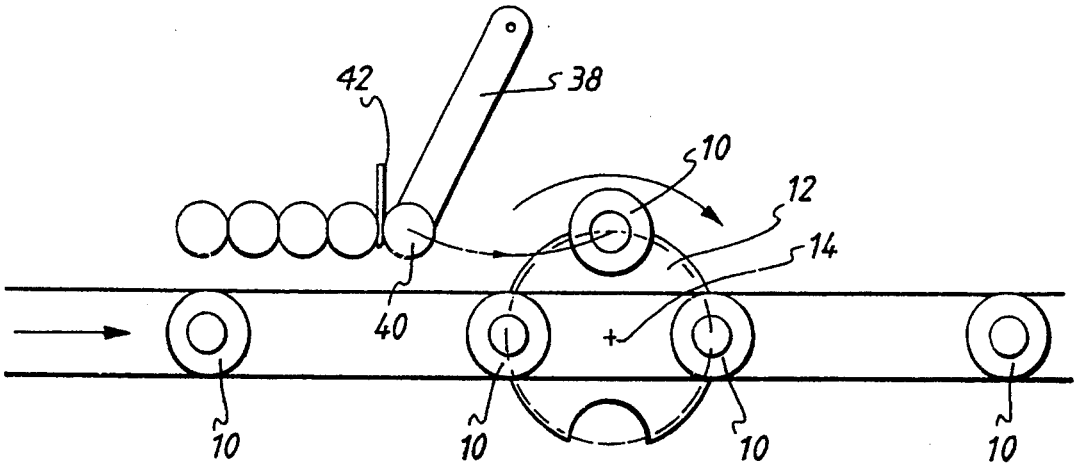
FIG. 2 shows a schematic view of the path of a container in the machine shown in FIG. 1 from above.

In FIGS. 1 and 2, containers 10, which are to be capped, are fed by a conveyor system (not shown) to the capping machine. Once the containers 10 reach the capping machine, they are held by a capping turret or retaining means 12. The capping turret 12 is rotatable around a central axis 14. The capping turret 12 is equipped with a hollow chuck shaft 16, which is disposed above the container feed path. The chuck shaft 16 is equipped with a chuck 18 at its lower end. The chuck shaft 16 is rotatable by a motor or rotary drive means 20 through a gear drive 22. The motor 20 and gear drive 22 are connected by a drive shaft 24. The drive shaft 24 also has fixed on it rotary movement monitoring means in the form of a shaft encoder 26 which monitors the rotation of the drive shaft 24, the rotation of the drive shaft 24 being proportional to the rotation of the chuck shaft 16. The output of the shaft encoder 26, which provides a pulse train absolutely related to the angular position of the motor shaft, is connected to a computer controller or control means 28. The motor 20 is controlled by a motor driver 30. The computer controller 28 is connected to the motor driver 30 to send signals thereto for controlling the angular velocity and torque applied by the chuck 18. An output from the motor driver 30 is also connected to the computer controller 28 to send signals back thereto and thus indicate the torque applied by the chuck 18. The chuck shaft 16 has a bracket 32 mounted on it (via a housing not shown in FIG. 1). The bracket 32 is connected to a cam follower 34 which, by following a cam 35, lowers the chuck shaft 16 in order to cap a container 10 and then raises it once this operation is complete. The level of the chuck shaft 16 is monitored via a vertical movement sensor 36, which is positioned adjacent to the chuck shaft 16. The output of the vertical movement sensor 36 is connected to the computer controller 28. The capping machine is further equipped with a cap transfer arm 38. The arm 38 transfers caps 40 from a cap feed chute (not shown) to a position above the container 10 to be capped, where it is picked up by the chuck 18. The items contained within the dotted line box in FIG. 1 are normally housed in a capping module 44.

FIG. 2 shows schematically the path of the container 10 through the capping machine. The container 10 is fed onto the capping turret 12. The turret 12 has four capping positions, which are angularly spaced apart from one another by 90°. The turret 12 rotates in a clockwise sense when viewed from above, and moves in 90° increments. When the container 10 has been moved through 90°, it is under the position where the chuck 18 picks up the cap 40 and starts to apply it to the container 10. The capping operation is completed by the time the turret 12 beings to be rotated a further 90° and the container 10 is set on to another conveyor belt to take it away for labelling and packing. To the side of the capping turret 12 there is the cap transfer arm 38 which pivots about one of its ends. The other end picks up caps 40 from the cap feed chute, and it is this end of the arm which, when swung, moves under the chuck 18. The feeding of the caps from the cap feed chute is controlled by a cap gate 42 which is activated (by means not shown) to feed another cap by the return of the empty arm 38.

Figure 3:
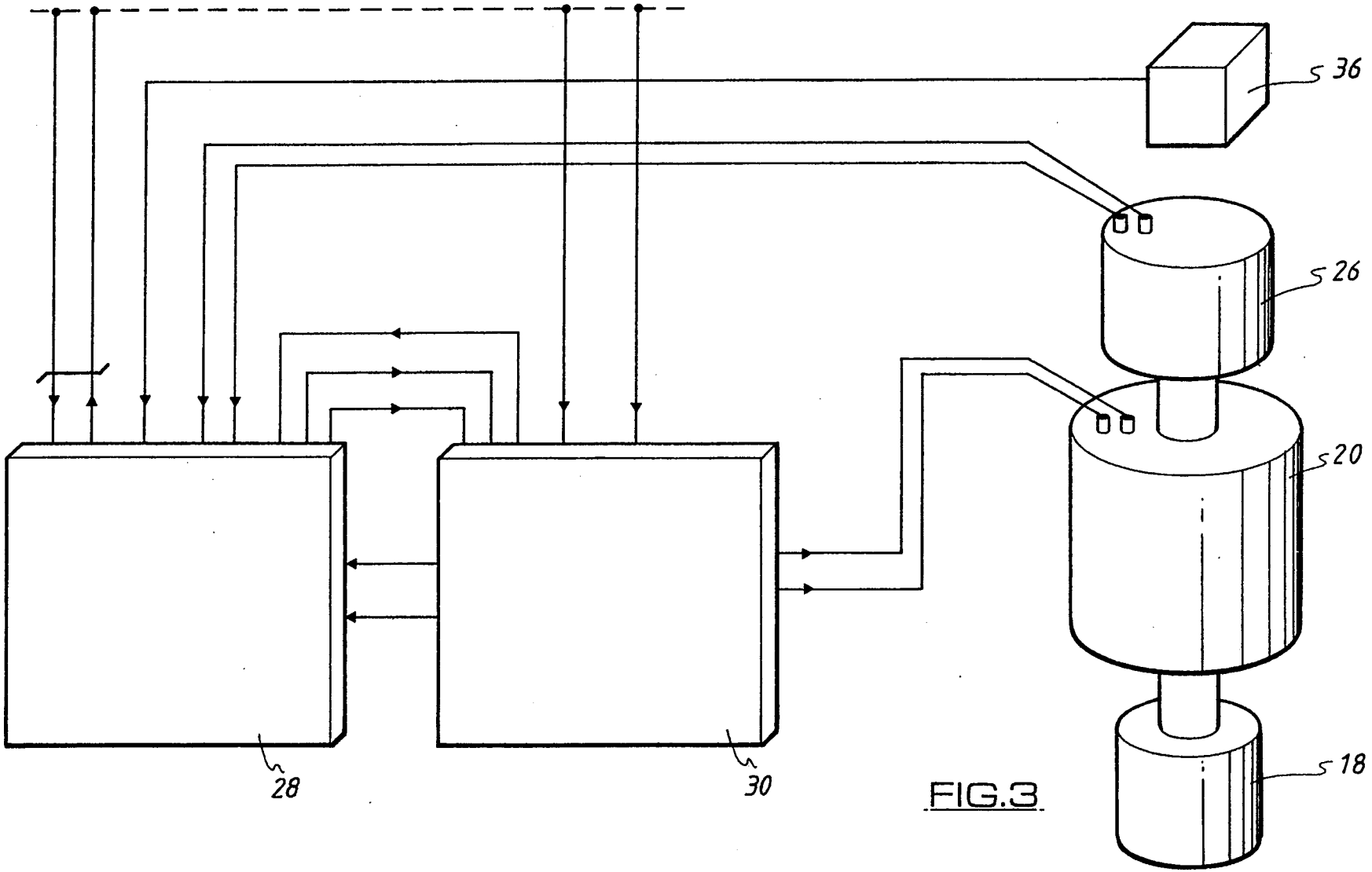
FIG. 3 shows a block diagram of the electrical connections between the main components of the machine shown in FIG. 1.

FIG. 3 shows the control connections of the capping machine as described above. The signals exchanged between the shaft encoder 26 and the vertical movement sensor 36 are digital and those between the motor driver 30 and the computer controller 28 are analogue. The motor driver 30 is an amplifier which amplifies the signals provided by the computer controller 28. The computer controller 28 is in the form of a single board and provides capping data for retrieval and accepts downloadable parameters from the input control (not shown) programmed by the operator.

Figure 4:
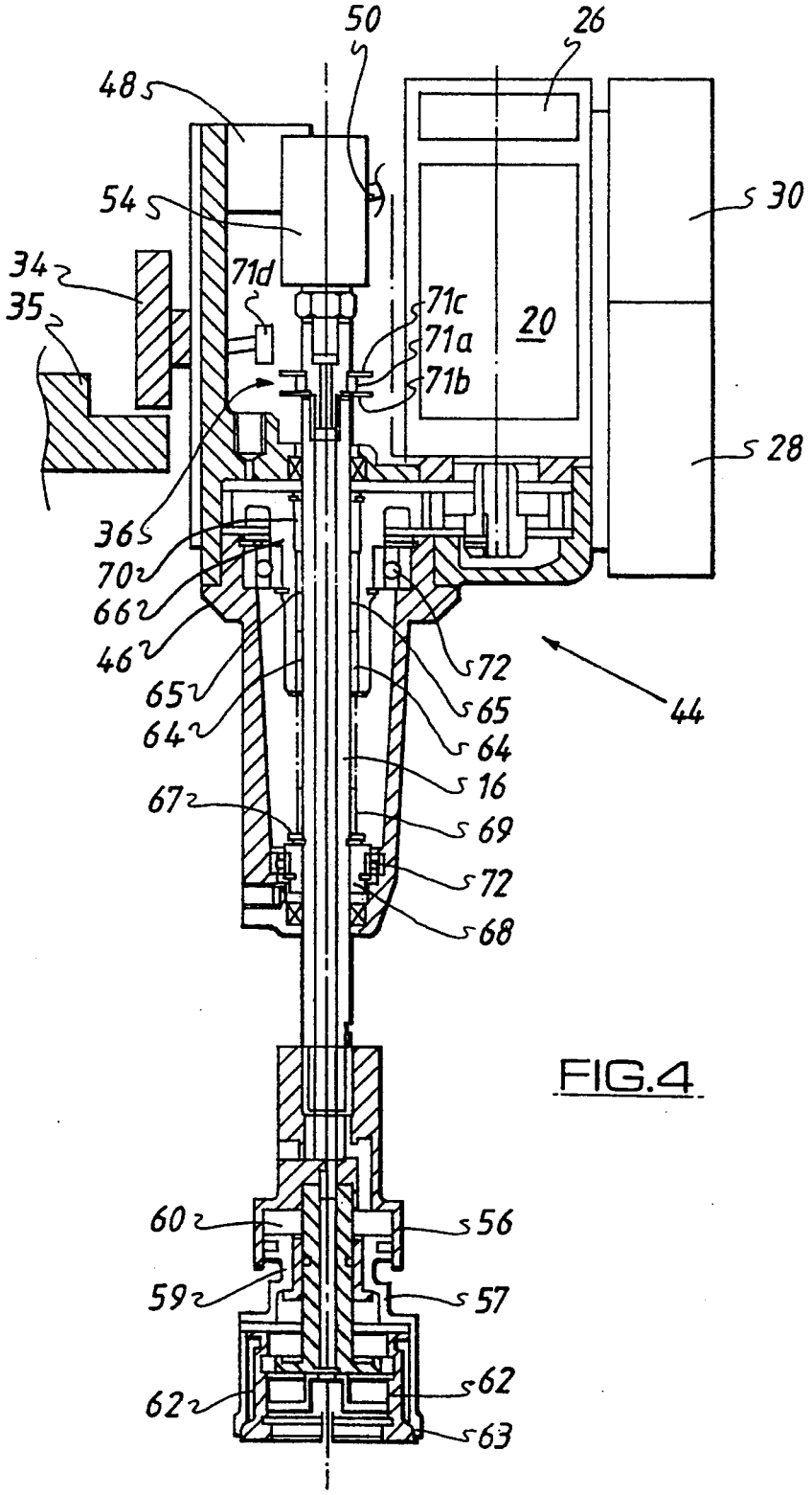
FIG. 4 shows an axial section of a capping module of the machine shown in FIG. 1.

FIG. 4 shows the capping module 44 in axial-section. The elements of the capping module are contained within a housing 46. The capping module 44 is mounted on the capping machine via a sliding bearing 48. A line 50 providing the chuck air supply is connected to an upper end of the hollow chuck shaft 16. The centre of the chuck shaft 16 is in airtight communication with the line 50, there being a rotary seal 54 between the line 50 and the chuck shaft 16. The hollow central section of the chuck shaft 16 extends down to a pneumatic chuck head adaptor 56. The chuck head adaptor 56 has an inverted U-shape in section.

The chuck head 57 contains a piston 59. The piston 59 has a gas-tight seal with the edges of the inside of U-shaped head adaptor 56. The piston 59 seals a space 60 which is in gas communication with the chuck air supply via the shaft 16 and the line 50. The piston 59 has pivotally attached round its circumference a number of jaws 62. The jaws 62 have a sloping outside surface such that when the piston 59 is pushed downwards by air pressure they are pivoted inwards towards the central axis of the module 44 by contact with a lip 63 on the lower end of the head 57. As a result of this action the jaws 62 grip the cap 40 to enable the container 10 to be capped.

The shaft 16 is rotated by the motor 20. The motor 20 rotates the shaft 16 via the gear drive 22. The shaft encoder 26 is mounted in the motor housing 20. The shaft encoder 26 monitors the rotation of the shaft 16 via the gear shaft 24 and the gear drive 22. The head adaptor 56 is supported for rotation, via the shaft 16, by the main bearings 72 which are mounted between the shaft 16 and the housing 46.

The shaft 16 is provided with axially extending splines 64 which slidingly interengage axially extending splines 65 of the shaft gear 66 of the gear drive 22. Downward movement of the shaft 16 relative to the housing 46 is limited by a circlip 67 abutting the inner bush 68 of the lower bearing 72. The shaft 16 is urged in a downward direction by a compression spring 69 which extends between the circlip 67 and the bottom of the gear 66. Upward movement of the shaft 16 relative to the housing 46 is therefore limited by full compression of the spring 69. The shaft 16 is constrained to linear upward and downward movement by the bush 68 and an upper bush 70.

Linear motion monitoring means 36 are constituted by a permanent magnet 71*a* sandwiched between two pole pieces 71*b* and 71*c*, fixed to the upper end of the shaft 16, and a Hall effect device 71*d* fixed to the housing 46 at a position thereof adjacent to the position at the centre of available travel of the magnet 71*a* relative to the housing 46.

The motor driver amplifier 30 and the computer controller 28 are positioned adjacent to the housing 46, with the motor driver amplifier 30 connected to the outside power supply and the computer controller 28 connected by an RS232 line (not shown) to an outside computer.

Figure 5:
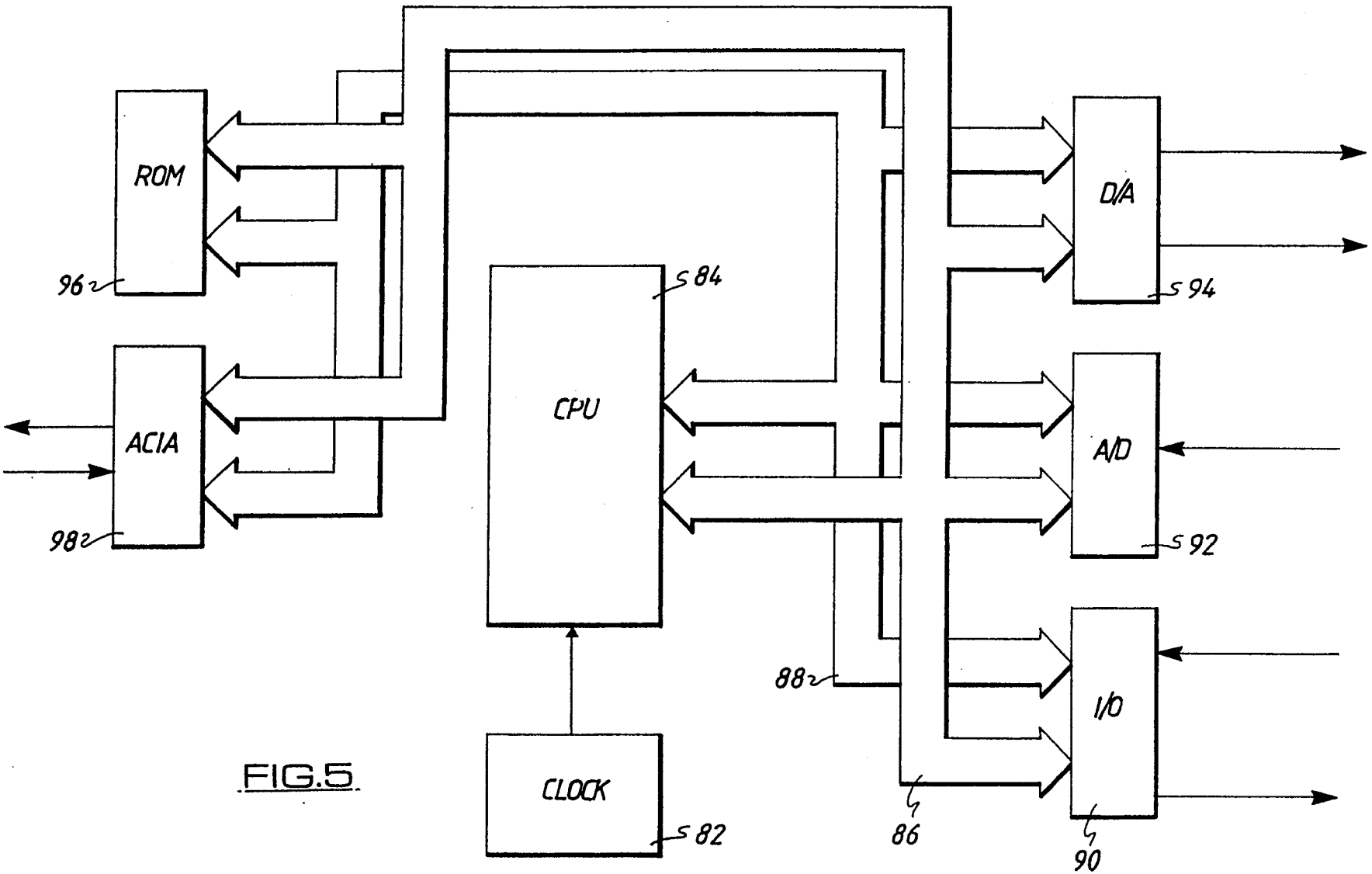
FIG. 5 shows a block diagram of a controller of the capping machine shown in FIG. 1.

In FIG. 5 there is illustrated a block diagram of the controller 28. In the controller 28, a clock 82 sends time signals to a central processing unit 84. The central processing unit 84 sends and receives data via a data bus 86 and sends instructions under control of an address bus 88. The address bus 88 and data bus 86 are both connected respectively to:

1) a digital input/output 90, which receives initial signals and outputs signals which control an air valve supplying the chuck;
2) an analogue to digital input 92, which receives signals relating to motor current which varies between 0 and 10 V;
3) a digital to analogue output 94 which gives out signals that control the applied torque and the motor angular velocity, both outputs being in the range 0 to 10 V;
4) a program memory 96, which is a read only memory containing program data; and
5) a serial communication port 98, which receives instructions from the operator and outputs results to information display or storage means, eg. printer or visual display unit, or computer system, via a cable connection using RS232 protocols.

Figure 6:
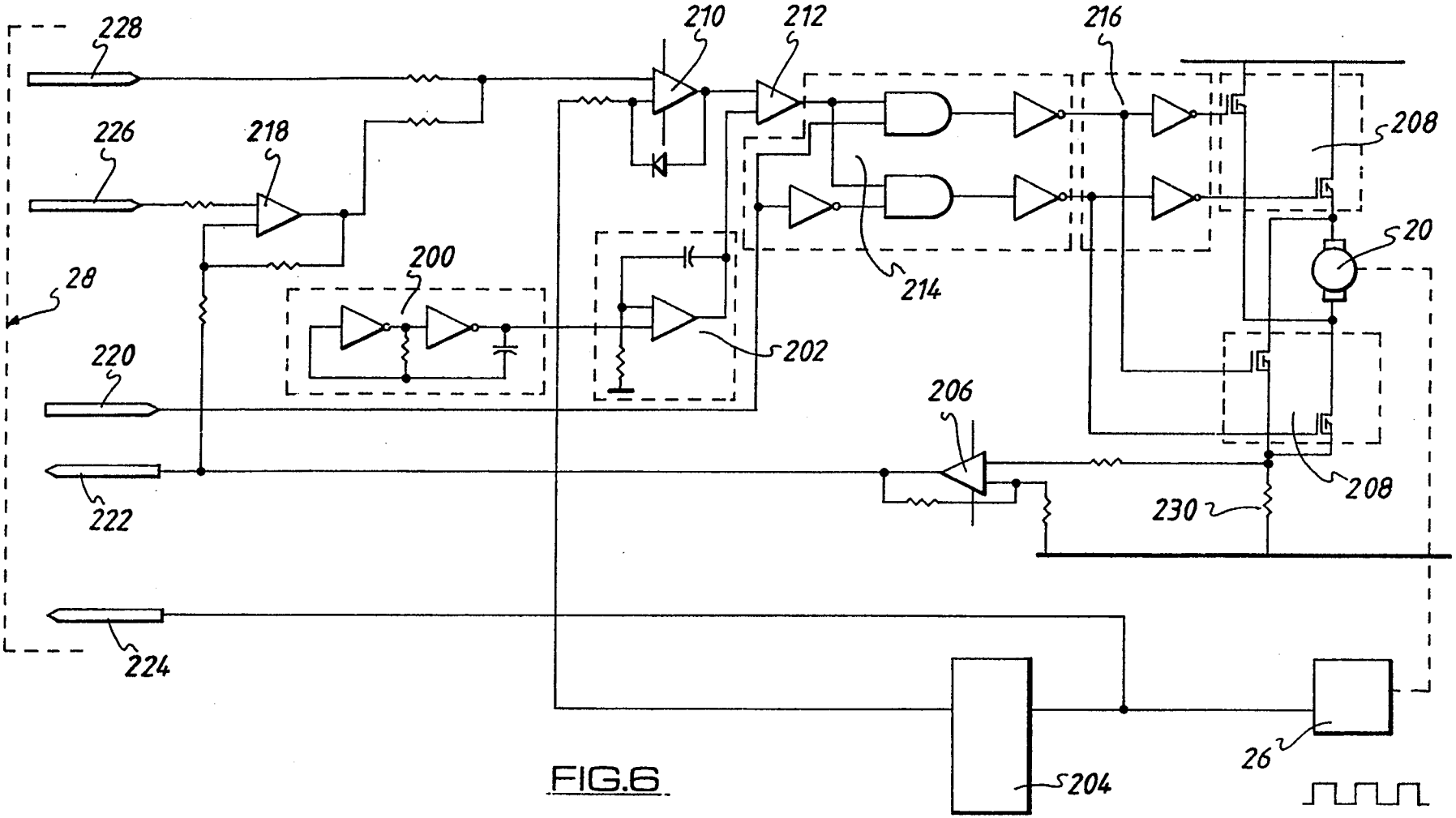
FIG. 6 shows a circuit diagram of a motor driver of the capping machine shown in FIG. 3.

In FIG. 6 the circuit diagram of the motor driver 30 is shown. The motor 20 is connected to a MOSFET transistor quadrature bridge arrangement, 208, of the motor driver 30, configured such that the motor may be energised in the forward or backward direction by selective switching on or off of the MOSFET transistors of the arrangement 208.

A CMOS logic inverter arrangement 216 is connected to the gates of the transistors of the arrangement 208 so as to switch the MOSFET transistors fully on or fully off in such a way that the motor is fully energised in the forward direction or reverse direction only, as required.

A logical AND gate plus a logical inverter arrangement 214 is connected to pass the control square wave signal to the inverter arrangement 216. A reverse digital input 220 derived from the computer controller 28 determines whether that signal passes to the forward or the reverse MOSFET transistors of the arrangement 208.

Two logical inverters 200 are connected with positive feed back components to produce a square wave signal. This signal is fed to an operational amplifier 202 connected with negative feedback via a capacitor arranged as an integrating circuit. This arrangement provides an output that is the mathematical integral of the input square wave, and is therefore described as a triangular wave that repeatedly changes from zero to maximum linearly, and then immediately from maximum to zero linearly.

The triangular wave is fed to an operational amplifier 212 which is configured as an analogue comparator. The output of the operational amplifier 212 will be maximum (described as duty on) when the instantaneous input voltage from the operational amplifier 210 is greater than the triangular wave instantaneous voltage. Conversely the output of the operational amplifier 212 will be zero (described as duty off) when the instantaneous input voltage from operational amplifier 210 is less than the triangular wave instantaneous voltage. It follows that the higher the input voltage to the comparator 212 from operational amplifier 210, then the ratio of duty on time to duty off time will change linearly from 0% to 100% as the input voltage from the operational amplifier 210 moves from zero to maximum.

The shaft encoder 26 is connected to a proprietary frequency-to-voltage converter 204 which is arranged to produce a voltage output according to motor speed. This speed derived signal is fed to the inverting input of the operational amplifier 210. A speed control input to the system 228 is connected externally to the computer controller 28, and internally of the motor driver 30 to the non-inverting input of the operational amplifier 210. The output of the operational amplifier 210 is thus proportional to the difference between the speed control voltage from the input 228 and the motor speed derived voltage from the converter 204. Thus the motor speed may be controlled within a closed loop arrangement.

A low value resistor 230 is connected in series with the motor 20 such that all motor current passes through it in a positive sense, regardless of the direction of rotation of the motor. This resistor will develop a voltage across it in proportion to the current flowing through the motor. This voltage is applied to an operational amplifier 206, which is arranged to amplify the voltage to a value in the zero to maximum range for the required motor current.

This current derived voltage is passed to the computer controller 28 for external processing via the terminal 222, and also to an inverting input of the operational amplifier 218. Thus the motor torque is controlled within a closed loop arrangement.

A torque demand current input 226 from the computer controller 28 is connected to the non-inverting input of the operational amplifier 218. The operational amplifier is thus configured to produce an output proportional to the difference between the torque demand voltage and the motor current derived voltage from the amplifier 206.

The motor shaft encoder 26 output is made available to the computer controller 28 via a connection 224 to enable positional control arrangements.

Analogue control of the motor in the forward and reverse direction is achieved by changing the duty cycle of a square wave signal such that the ratio of motor on time to motor off time is infinitely variable. This cycling of the on to off state is carried out typically at 20 kHz, and this frequency is orders of magnitude faster than the mechanical time constants of the motor assembly. Thus the motor operates according to the average voltage or current applied.

Figure 7:
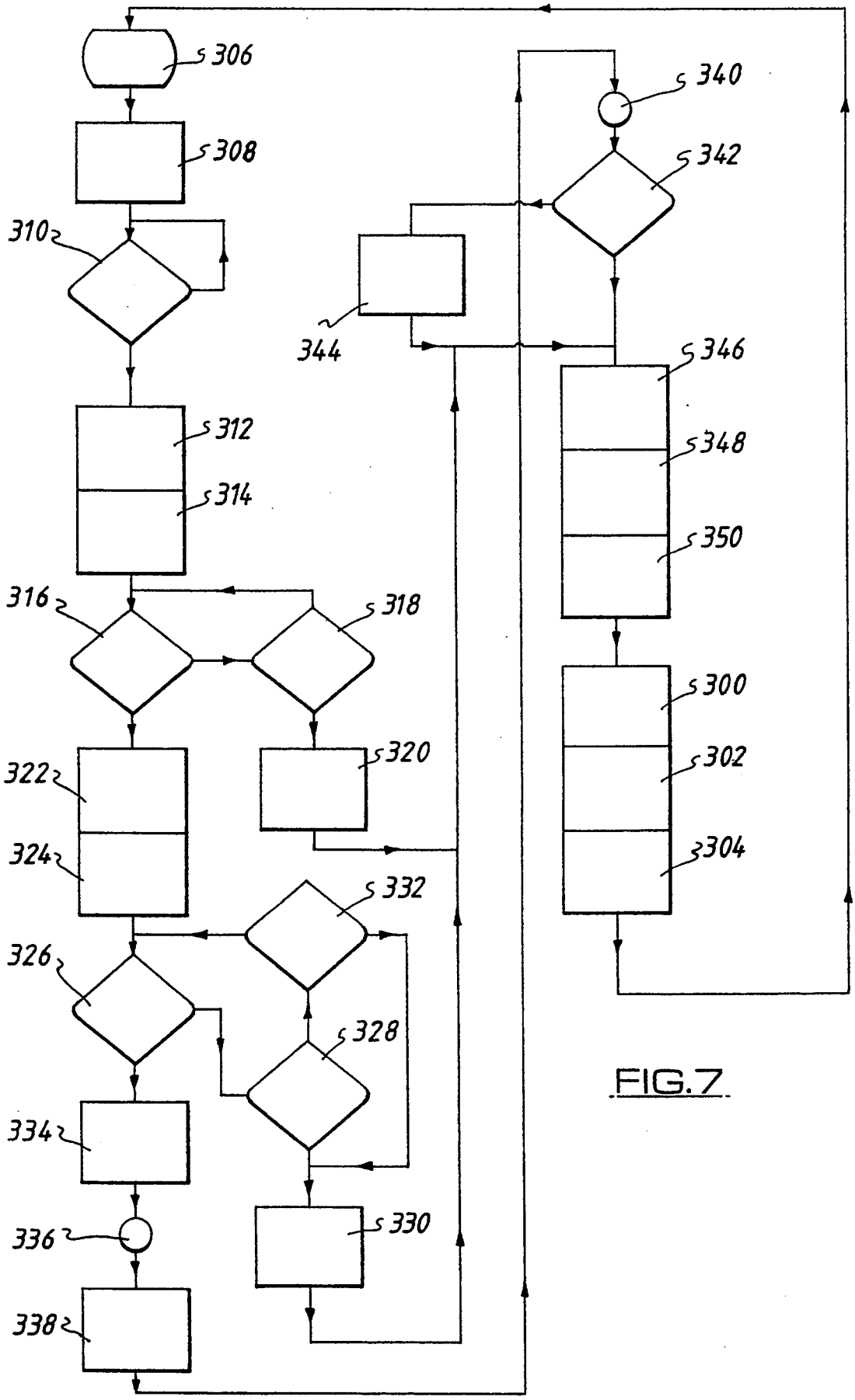
FIG. 7 shows a flow chart of the operation of the capping machine shown in FIG. 1.

FIG. 7 shows a flow diagram of how the computer controller 28 is programmed and thus how the above described capping machine works. The first step 300 is to load a new cap into the chuck 18 from the cap transfer arm 38. In the step 302 the jaws 62 of the chuck heads 56 close gripping the cap 40. The chuck 18 is then lowered in step 304 onto the container 10. When the chuck 18 makes contact with the container 10 the capping sequence is started in step 306. Initially the chuck head 56 rotates against the screw-on sense of the thread of the container at a slow angular velocity in step 308. As the cap is rotated the vertical movement sensor 36 looks for a level fall in the vertical position of the chuck 18. The vertical movement sensor 36 is then seen to constitute screwthread-disengagement monitoring means. In step 310 this rotation is continued until the start of the thread is thus detected. Once this has been detected the computer controller 28 then sets the motor torque to maximum in step 312 and the angular velocity of the chuck to high in the opposite sense (the screw-on sense of the thread on the containers' 10 neck) in step 34.

The motor shaft encoder 26 then checks the angle that the chuck has rotated in step 316. If it has reached x°, which is the free thread angle on the container neck (this will have been predetermined and loaded into the computer controller 28), then the chuck 18 proceeds onto the next step 322 in the capping process. If the angle reached is not x°, then in step 318 the controller 28 checks whether the chuck 18 has stalled. If it has not, rotation is continued and step 316 continued with.

If the chuck has stalled then in step 320 the controller 28 rejects the capping as having an incorrect angle, possibly due to a bad thread on either the cap 40 or the container 10 and proceeds to the stop step of the capping processing.

In step 322 the torque applied by chuck 18 is set to a pre-determined torque T1. The chuck 18 in step 324 is then advanced very slowly in the same sense as in step 314. In step 326 torque is applied by the chuck 18 for a set time and is measured. If this measured torque Tm is greater than or equal to the predetermined torque T1 then the next step is step 334. If the torque measured Tm is not greater than torque T1 then step 328 follows, in which the computer controller 28 checks whether the maximum time taken to tighten the cap has been exceeded. If it has the computer controller 28 rejects that particular capping as bad torque in step 330 and the capping process is stopped. If the time is not exceeded then in step 332 the measured torque is compared with a predetermined overtorque value T2. If it is exceeded then step 330 follows as above, otherwise the tightening of the cap is continued in step 326.

In step 334 after the correct torque has been applied the chuck 18 is stopped. Step 336 allows a delay of 30 mS to allow the component parts of the container and cap 18 to settle. In step 338 the rotation of the chuck 18 is reversed and the torque applied by the chuck 18 is set to a value where the set torque T1 is multiplied by a torque test factor y, in order to carry a twist-off test to test whether the cap 40 is screwed on satisfactorily.

Step 340 allows a delay of 50 mS to allow the container components to settle. In step 342 the motor shaft encoder 26 then checks what angle of rotation has been achieved by the chuck 18. If this angle is greater than the reverse test limit Z° then the capping is rejected as a twist-off fail by step 344. If the test in step 342 is passed then the capping machine proceeds to the end of the capping process. In step 346 the chuck 18 stops, in step 348 the chuck 18 is released and then raised in step 350.

Figure 8:
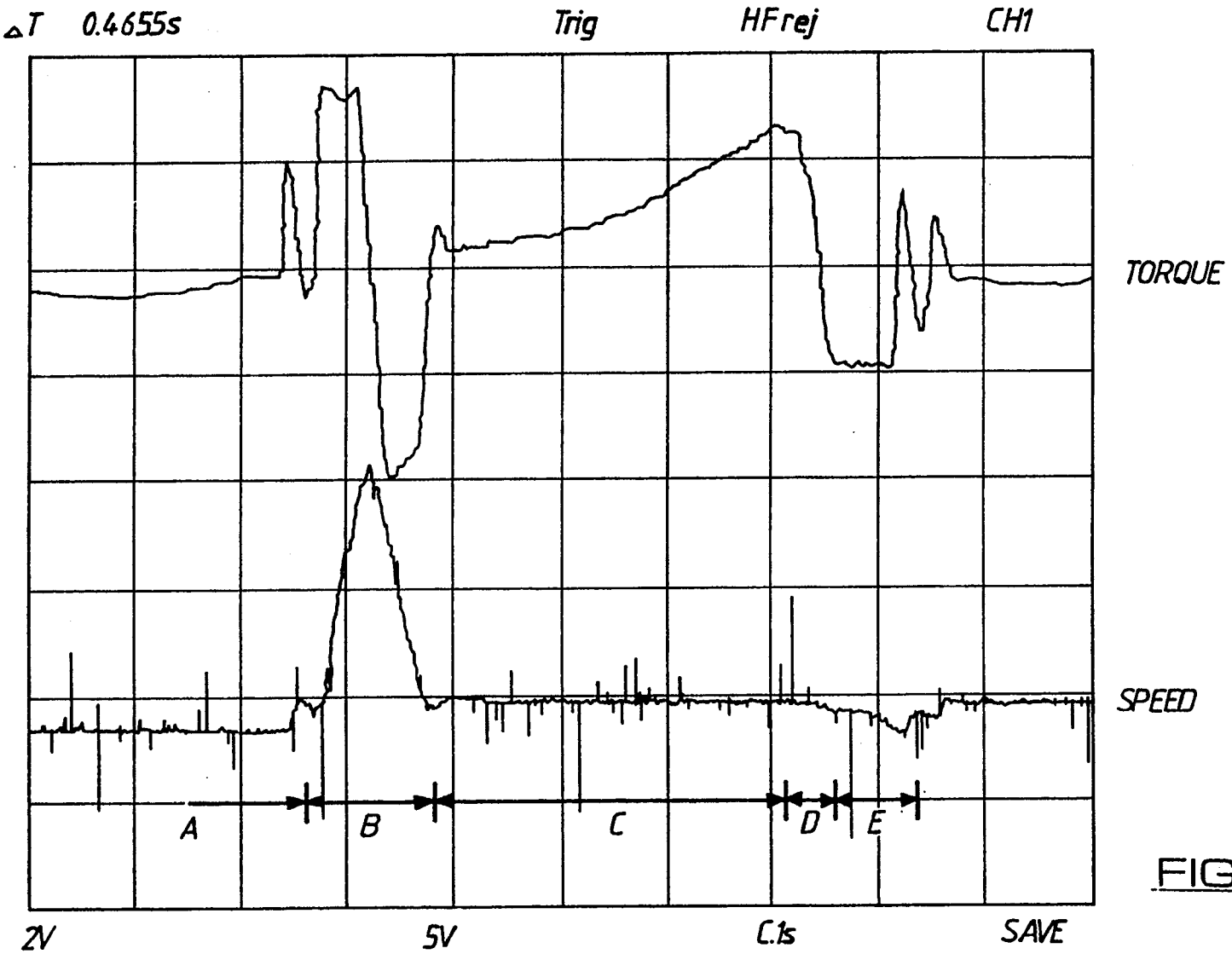
FIG. 8 shows explanatory graphs representative of measured torque and angular velocity of chuck against time during a capping operation of the machine shown in FIG. 1.

FIG. 8 shows graphs of the angular velocity of the chuck and the torque applied by the chuck. In Part A of the graph which corresponds to the slow reverse of the chuck seeking the thread it can be seen that the torque and angular velocity remain approximately constant until there is a blip in the torque as the start of thread is found owing to the chuck dropping and the need for more torque to maintain the chuck's angular velocity and then reverse torque to change the direction of the chuck. In section B the chuck is moving fast forward for x° to screw on the cap. This results in a large peak for angular velocity and a sharp positive peak for torque as the chuck angular velocities up and sharp negative peak for torque as the chuck is slowed. Section C shows the period while the cap is tightened. In this section angular velocity remains constant and torque slowly increases. In section D the chuck 18 dwells while the container parts are settled and thus there is a decrease in angular velocity and torque to zero as the chuck stops. In section E the chuck is applying reverse twist-off which results in a negative peak for torque which is maintained and a negative blip on angular velocity as some movement occurs and then the cap holds. There is then a positive peak on torque as the torque is reversed to let off the torque applied by the chuck 18.

Figure 9:
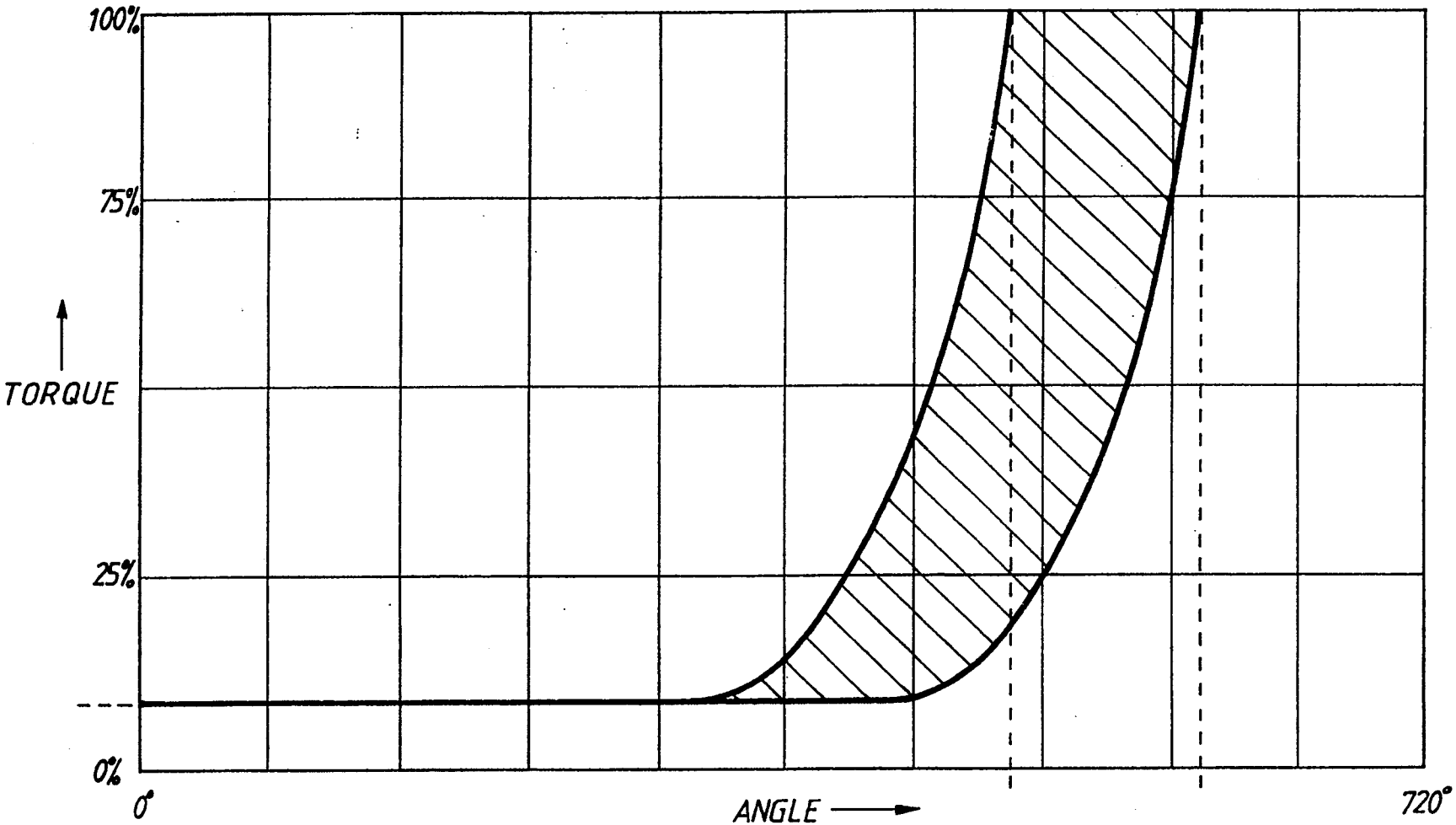
FIG. 9 shows a further explanatory graph.

FIG. 9 shows non-inertial reactionary torque to which the chuck is subjected to by the cap as a function of the angle through which the cap has been rotated beyond the start-of-thread position. Any curve within the two illustrated curves in FIG. 10 is acceptable. Otherwise, if the curve lies outside that window, the cap and its associated container will be rejected.

Numerous modifications and variations to the illustrated capping machine will readily occur to a reader of normal skill in the art without taking the resulting construction outside the scope of the present invention. For instance the vertical movement sensor 36 could be dispensed with and the torque sensor used instead to detect the start of the screw-thread.

The motor drive 30 may be replaced by a proprietary servo-amplifier type No. SSA-8/80 manufactured by Elmo Motion Control Limited, of Petah Tikva, Israel.

Whilst the accompanying drawings illustrate a single spline machine with a single chuck, it will be appreciated that it could be modified to have two or more splines with respective chucks, each at the same stage in the capping procedure at any given moment, or each at respective different stages in the capping procedure at any given moment.

Step 322 in FIG. 7 may involve the reversal of the torque applied to the chuck by the motor 20, in which case the angle x° may be half the free thread angle on the container neck, so that the rotary speed of the chuck is ramped up and ramped down and is thus triangular as a function of time.

We claim:

1. A capping machine for capping a container having a screw-threaded neck portion with a correspondingly screw-threaded cap, the machine comprising retaining means for retaining such a container in a retaining position and a rotary chuck for holding such a cap above the capping position, forward and reverse rotary drive means coupled to the chuck for rotating such a cap in both a clockwise sense and an anticlockwise sense, rotary movement monitoring means constructed and positioned to monitor rotation of the chuck, linear motion means coupled to the chuck to move the chuck both downwardly and upwardly, screwthread-disengagement monitoring means arranged to monitor when the screwthreads of such a cap and neck disengage momentarily as the cap is rotated in an unscrewing sense on the neck and the linear motion means urge the chuck downwardly, and control means connected to the rotary drive means, the rotary movement monitoring means, and the screwthread-disengagement monitoring means, the control means being such as to rotate the cap in the unscrewing sense, monitor the relative angular position of the cap when the screwthreads of the cap and the neck momentarily disengage, by means of the screwthread-disengagement means, and then to rotate the cap in a screwing sense by a predetermined amount dependent upon the length of the screwthreads.

2. A capping machine according to claim 1, in which the control means are such as to rotate the cap in the screwing sense by the said predetermined amount at a relatively high angular velocity, and then to rotate the cap in that sense by a further amount, which is small relative to the said predetermined amount, at a relatively low angular velocity, to tighten the cap on the neck.

3. A capping machine according to claim 1, in which the control means are such as to rotate the cap in the screwing sense by the said predetermined amount at a relatively high rate of change of angular velocity, and then to rotate the cap in that sense by a further amount, which is small relative to the said predetermined amount, at a relatively low rate of change of angular velocity, to tighten the cap on the neck.

4. A capping machine according to claim 1, in which store means are provided in the control means to store the values of the said predetermined amount.

5. A capping machine according to claim 4, in which the control means are such as to run an initialising procedure at the start of a capping run, in which such a cap is screwed onto such a neck at a slow angular velocity, a measure of the screwthread length is made, and the said predetermined amount is determined and stored in the store means.

6. A capping machine according to claim 1, in which the rotation of the cap by the said predetermined amount is effected by both an angular acceleration and also by a subsequent angular deceleration.

7. A capping machine according to claim 1, in which the screwthread-disengagement means comprise torque monitoring means coupled to the rotary drive means to monitor the torque applied by the latter, the torque monitoring means also being connected to the control means, the latter monitoring the relative angular position of the cap on the neck when such torque changes as the screwthreads momentarily disengage.

8. A capping machine according to claim 1, in which the screwthread-disengagement means comprise linear motion monitoring means constructed and positioned to monitor downward and upward movement of the chuck, the linear motion monitoring means also being connected to the control means, the latter monitoring the relative angular position of the cap on the neck when the chuck moves downwardly as the screwthreads of the cap and neck momentarily disengage.

9. A capping machine according to claim 1, in which after the container has been capped the chuck applies a torque in the unscrewing sense which is a predetermined fraction of the desired tightening torque, to test the capping.

10. A capping machine according to claim 1, in which the rotary drive means are speed controlled.

11. A capping machine according to claim 1, in which the rotary drive means are torque controlled.

* * * * *